US008215826B2

(12) United States Patent
Zuppiger et al.

(10) Patent No.: US 8,215,826 B2
(45) Date of Patent: Jul. 10, 2012

(54) DEVICE AND METHOD FOR MOVING LIQUID CONTAINERS

(75) Inventors: Adi Zuppiger, Siebnen (CH); Roland Fuchs, Dübendorf (CH); Urs Knecht, Hombrechtikon (CH)

(73) Assignee: Tecan Trading AG, Mannedorf (CH)

( * ) Notice: Subject to any disclaimer, the term of this patent is extended or adjusted under 35 U.S.C. 154(b) by 790 days.

(21) Appl. No.: 11/913,363

(22) PCT Filed: May 4, 2006

(86) PCT No.: PCT/CH2006/000243

§ 371 (c)(1), (2), (4) Date: Oct. 30, 2008

(87) PCT Pub. No.: WO2006/116892

PCT Pub. Date: Nov. 9, 2006

(65) Prior Publication Data

US 2009/0097948 A1 Apr. 16, 2009

(30) Foreign Application Priority Data

May 4, 2005 (CH) ..... 787/05

(51) Int. Cl.

| | |
|---|---|
| ***B01F 11/00*** | (2006.01) |
| ***B01F 11/02*** | (2006.01) |
| ***B65H 1/00*** | (2006.01) |

(52) U.S. Cl. ..... 366/208; 366/110; 366/111; 366/127; 366/216; 366/218; 414/220.01; 414/806

(58) Field of Classification Search ..... 366/208, 366/216, 218, 110, 111, 127; 414/222.01, 414/806

See application file for complete search history.

(56) References Cited

U.S. PATENT DOCUMENTS

| | | | | |
|---|---|---|---|---|
| 3,601,372 | A | 8/1971 | Harmes | |
| 4,199,265 | A | 4/1980 | Sanderson et al. | |
| 4,238,729 | A * | 12/1980 | MacFadden et al. | 324/152 |
| 5,259,672 | A | 11/1993 | Rowe | |
| 5,409,312 | A | 4/1995 | Fletcher | |
| 6,508,582 | B2 * | 1/2003 | Friedman | 366/110 |
| 6,977,722 | B2 * | 12/2005 | Wohlstadter et al. | 356/246 |
| 2003/0081499 | A1 * | 5/2003 | Friedman | 366/208 |
| 2004/0152188 | A1 * | 8/2004 | Yamamoto et al. | 435/287.3 |

FOREIGN PATENT DOCUMENTS

| | | |
|---|---|---|
| EP | 1 188 474 | 3/2002 |
| EP | 1 201 297 | 5/2002 |
| FR | 934 278 | 5/1948 |
| GB | 2 254 423 | 10/1992 |

* cited by examiner

*Primary Examiner* — Nathan Bowers
*Assistant Examiner* — Gautam Prakash
(74) *Attorney, Agent, or Firm* — Notaro, Michalos & Zaccaria P.C.

(57) ABSTRACT

A method according to Claim 25, wherein essentially homogeneous material mixtures are achieved or maintained in these liquid containers.

27 Claims, 3 Drawing Sheets

DEVICE AND METHOD FOR MOVING LIQUID CONTAINERS

RELATED PATENT APPLICATIONS

This patent application claims priority of the Swiss patent application No. 0787/05 filed on May 4, 2005 and of the international application PCT/CH2006/000243 filed on May 4, 2006, the whole disclosures of these applications being incorporated by reference herein for all purposes.

RELATED FIELD OF TECHNOLOGY

The present invention relates to a device for moving liquid containers, which comprises a support unit implemented to receive liquid containers; a base unit, in relation to which the support unit is mounted as essentially horizontally freely oscillating using connection elements; and movement means for moving the support unit in relation to the base unit.

Industrial branches which are concerned with biochemical technologies in pharmaceutical research and/or in clinical diagnostics, for example, require facilities for processing liquid volumes and liquid samples. Automated facilities typically comprise an individual pipetting device or multiple pipetting devices, which are used on liquid containers, which are often located on the work table of a workstation. Such workstations are often capable of executing greatly varying work on these liquid samples, such as optical measurements, pipetting, washing, centrifuging, incubation, and filtration. One or more robots, which operate according to Cartesian or polar coordinates, may be used for sample processing on such a workstation. Such robots may support and reposition liquid containers, such as sample tubes or microplates. Such robots may also be used as so-called "robotic sample processors" (RSP), for example, as a pipetting device for aspirating and dispensing, or as a dispenser for distributing liquid samples. Such facilities are preferably monitored and controlled by a computer. A decisive advantage of such facilities is that large numbers of liquid samples may be processed automatically over long periods of time of hours and days, without a human operator having to engage in the processing process.

RELATED PRIOR ART

Stirring devices ("stirrers"), which have been known for some time, use a moving body immersed in the liquid of a liquid container retained fixed in place to mix the materials present in this liquid. This stirring body is externally driven mechanically directly (as in a kitchen mixer) or using magnetic coupling (cf., for example, U.S. Pat. No. 4,199,265 or EP 1 188 474).

In contrast, shakers, which are also known in practically all laboratories which are concerned with mixing materials with liquid, move the liquid container itself. Such shakers which move the liquid containers in a thermostatically controlled bath are known, for example, from U.S. Pat. No. 3,601,372: the support device of this shaking apparatus is not freely oscillating, but rather fixed, however, it is connected via three crankshafts to a stationary intermediate floor so it is movable and may execute a circular movement corresponding to the deflection of the crankshaft. Permanent magnets directed downward are attached to one of these crankshafts, which produce a magnetic coupling to a permanent magnet situated outside the water bath and driven via a fixed motor. The motor drive and the support surface are at least mechanically decoupled from one another by this configuration. Other shakers execute a rapid circular movement using a rubber hollow spherical cap, in which a test tube or a sample tube is retained by hand. Shakers which move a platform linearly or circularly in a horizontal plane are also known; baths for staining polyacrylamide gels are laid on these platforms, for example. Rocking platforms are also known.

Further shakers equipped with solenoid drives, however, are known from U.S. Pat. No. 5,259,672, GB 2 254 423, FR 934 278, and EP 1 201 297. All of these devices share the feature that they comprise exciter coils and pole cores, the exciter coils being fastened to a support device and the pole cores to a base plate and/or a housing (or vice versa). The disadvantage results from this configuration of the two main components of the solenoids and the at least magnetic coupling between the support device and the housing connected thereto that shocks of the surroundings are transmitted to the support device and vibrations of the support device are transmitted to the surroundings.

In connection with the present invention, whenever a device for moving liquid containers is referred to, it is thus a shaker which moves the liquid containers to mix, shake, or stir material mixtures. Such material mixtures may comprise suspensions, solutions, and emulsions.

U.S. Pat. No. 5,409,312 discloses a device, using which a magnetic stirrer may be converted into a magnet-driven orbital shaker. This device comprises a horizontally situated, rectangular base plate and a support plate, also rectangular, situated parallel thereto. Four ball bearings are situated in the corners and opposite one another, which allow the support plate for receiving a liquid vessel to execute a free or circular orbital movement. The support plate has a circular magnet in the center on its bottom side, and is thus magnetically coupled to the rotatable magnet of the magnetic stirrer. Such magnetic stirrers are known, however, for discharging strong vibrations to their surroundings, in particular onto the table on which they stand.

U.S. Pat. No. 6,508,582 discloses an electromagnetically driven linear shaker for microplates, which causes a support plate connected via leaf springs to a base plate to vibrate up to frequencies of 120 Hz (7200 reciprocal movements per minute). The microplates, whether a single standard plate, a single "deep-well microplate", or entire stacks thereof, are fixed on the support plate using clamping devices. On one hand, these clamping devices are not suitable for automated or robotic charging of the support plate with such microplates. On the other hand, the discharge of strong vibrations to the substrate is also a concern here, because the direct movement of the support plate and all liquid containers situated thereon requires a correspondingly strong electromagnet.

Published patent application US 2003/0081499 A1 discloses an electromagnetically or mechanically driven multidirectional shaker for microplates or sample tubes. A first support plate is suspended on leaf springs in relation to a base plate, so that it may oscillate essentially horizontally and freely in a specific first direction. A second support plate is suspended on this first support plate on leaf springs in such a way that it may oscillate essentially horizontally and freely in a second direction perpendicular to the first direction. The oscillations are generated by two electromagnets oriented in the particular oscillation directions, in that a core fixed on the particular support plate is provided for each support plate, which is partially inserted into each of the electromagnets. Alternatively, the support plates are oscillated by two electric motors oriented perpendicular to the particular oscillation direction using eccentric drive wheels directly impinging the edge of the particular support plate; in this case, springs counteract the eccentric drive wheels. The discharge of strong vibrations to the substrate is also a concern here, because the direct movement of the support plate and all liquid containers situated thereon requires a correspondingly strong electromagnet or a correspondingly strong electric motor.

OBJECT AND SUMMARY OF THE PRESENT INVENTION

The present invention is based on the object of suggesting an alternative device for moving liquid containers, which remedies or at least minimizes the disadvantages from the prior art.

This object is achieved according to a first aspect in that a device as disclosed herein is suggested. Such a device according to the present invention for moving liquid containers comprises:

- a support unit implemented to receive liquid containers;
- a base unit, in relation to which the support unit is mounted using connection elements so it is essentially freely horizontally oscillating, and
- movement means for moving the support unit in relation to the base unit.

The device according to the present invention is characterized in that the support unit comprises at least one support element, on which at least one movement mass is fastened so it is movable. This at least one movement mass interacts with movement means—fastened to the same support element—and is movable by these movement means. The movements of this at least one movement mass set the same supporting support element and the liquid containers received using the support unit into corresponding counter movements.

This object is achieved according to a second aspect in that a method as disclosed herein is suggested. In such a method according to the present invention for moving liquid containers, in particular using a device as just cited, liquid containers are received using a support unit—which is mounted using connection elements so it is essentially horizontally freely oscillating in relation to a base unit—and this support unit is moved in relation to the base unit using movement means. The method according to the present invention is characterized in that at least one support element of the support unit, on which at least one movement mass is fastened so it is movable, is moved using movement means—fastened to the same support element—which interact with this at least one movement mass, in such a way that the movements of this at least one movement mass set the same supporting support element and the liquid containers received using the support unit into corresponding counter movements.

Additional, preferred, and inventive features result from disclosure of this application and the attached drawings.

BRIEF INTRODUCTION OF THE DRAWINGS

The device and the method according to the present invention are explained in greater detail on the basis of schematic drawings of exemplary embodiments, which do not restrict the scope of the present invention.

DETAILED DESCRIPTION OF THE PRESENT INVENTION

Figure 1:
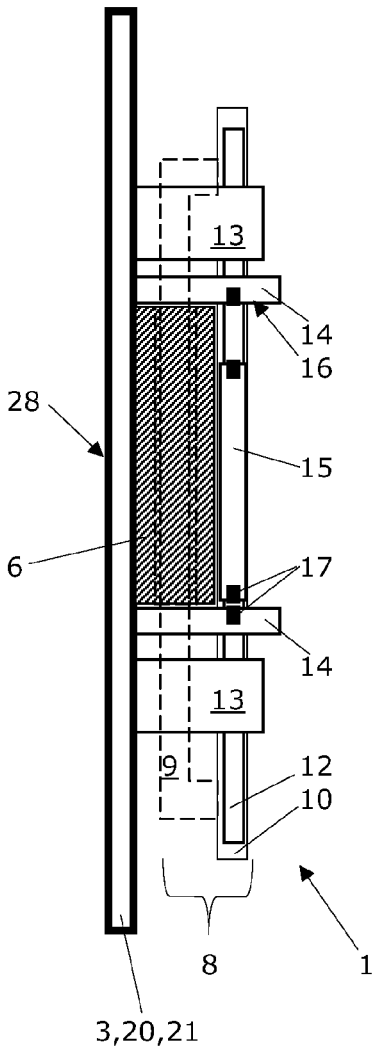
FIG. 1 shows a side view of a horizontally freely oscillating support unit according to the present invention for receiving liquid containers.
Figure 2:
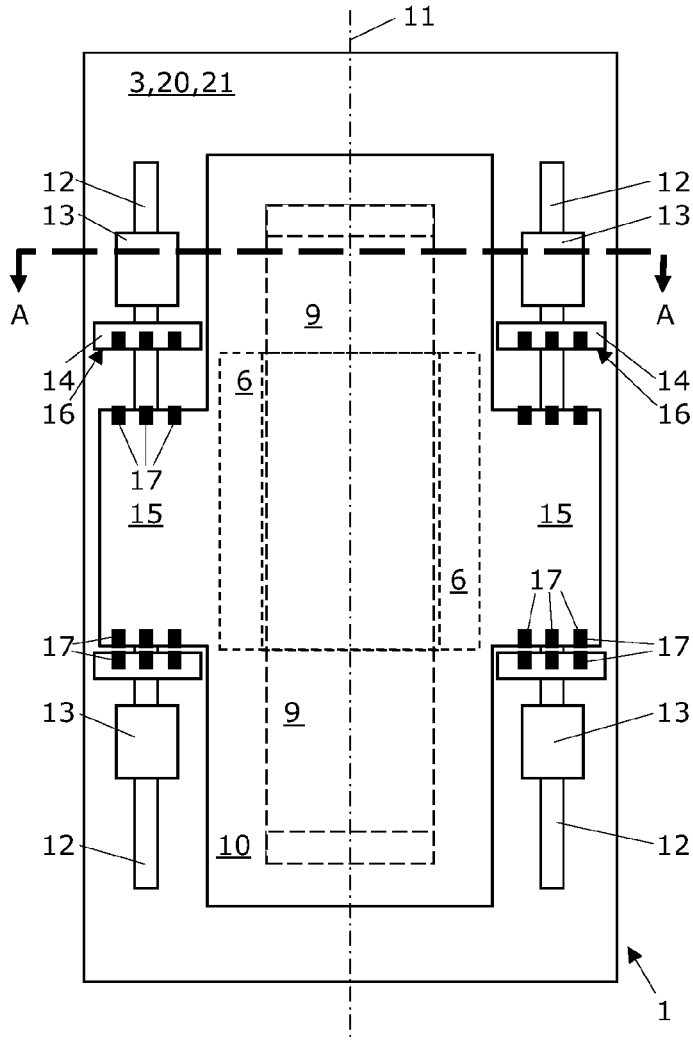
FIG. 2 shows a bottom view of the support unit from FIG. 1 having permanent magnets as stop springs and drive support.
Figure 3:
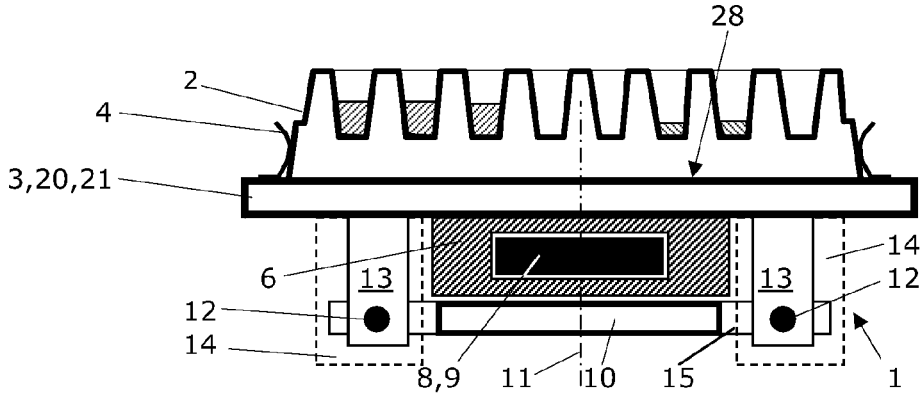
FIG. 3 shows a cross-section of the support unit from FIG. 1 along line A-A.

FIGS. 1, 2, and 3 show the side, bottom, and outline views of a support unit of a device 1 for moving liquid containers 2. The support unit 3 is implemented to receive liquid containers 2. Such liquid containers in the form of sample tubes may be placed on the support unit in frames or racks (not shown) suitable for this purpose. Liquid containers in the form of microplates having 96 or 384 or more or fewer wells, for example, (cf. FIGS. 3 and 5) may also be placed on the support unit 3. Retention springs 4 or other suitable means (not shown) attached to the support unit prevent liquid containers 2 placed or laid on the support unit 3 from slipping around or otherwise moving in an uncontrolled way upon movement of the support unit. Such means also comprise clamping levers, which may be opened by robot grippers, so that completely automatic charging of the support unit 3 with liquid containers 2 and secure retention of these liquid containers on the surface of the support unit 3 are possible. The support unit 3 is mounted so it is essentially horizontally freely oscillating in relation to a base unit 5 (not shown here; cf. FIG. 4) using connection elements 7.

FIG. 1 shows a side view of a horizontally freely oscillating support unit 3 according to the present invention for receiving liquid containers 2. A movement mass 8 is situated on the support unit 3 so it is movable, which is movable by movement means 6. This movement mass 8 comprises a movable magnet 9 implemented as a so-called oscillator, which may be moved back and forth by movement means 6 in the form of an electromagnetic coil in the direction of the axis of symmetry 11 (cf. FIG. 2). The magnet is connected to a plate 10, which is preferably made of iron and forms a closed circuit with the magnet 9. The plate 10 is thus also part of the movement mass 8.

The electromagnetic coil 6 is mounted fixed on the support unit 3. The oscillator 9 or "moving magnet" is mounted on the support unit 3 so it is movable. This mounting comprises two sliding rods 12, which are each mounted to slide in a pair of sockets 13. Two stop plates 14 delimit the horizontal mobility of the oscillator 9 and of the movement mass 8. In order that the transverse flanges 15 of the oscillator 9 do not hit the stop plates 14, strong permanent magnets 17 homopolar to one another are situated on the transverse flanges 15 and also on the stop faces 16 of the stop plates 14 directed toward them. By the repelling effect of the like poles of these strong permanent magnets 17 opposite one another, the transverse flanges 15 are additionally accelerated in the opposite direction after braking, so that these permanent magnets 17 also act as a drive—at least in direct proximity to the stop plates 13. Depending on the strength and number of the permanent magnets 17, these stop springs or this drive effect may be strengthened or attenuated. If the movement mass 8 that is movably situated on the support unit 3 is moved by these movement means 6, the movement of this movement mass 8 sets the support unit 3 and the liquid containers 2 received thereby (cf. FIG. 3) into a corresponding counter movement in the direction of the sliding rods 12 (into or out of the plane of the drawing in FIG. 3).

It is clear that it is sufficient for a linear movement of the support unit 3 if only one movement mass 8 is fastened thereon. If the support unit 3 is to execute a more complex movement, a rotating movement mass 8 may be fastened thereon. However, the linear mounting shown having two sliding rods 12 must be replaced by another mounting, which allows the support unit 3 a rotational movement opposite to the rotating movement mass 8. For this purpose, the support unit 3 may be suspended on limp, flexible elements such as cords, narrow coiled springs, and the like. Alternatively thereto, the support unit 3 may also be supported on springy, stiff elements such as wires, wide coiled springs, and the like. The support unit 3 comprising a single support element 20 may thus execute a rotating reciprocating movement which is opposite to the rotational movement of a rotary movement mass 8. This alternative, orbiting movement of the movement mass 8 may be caused by an electric motor, on whose drive-shaft the movement mass 8 is eccentrically fastened (not shown).

If the support unit 3 is to execute a rotational movement without rotating electric motors and eccentrically situated movement masses 8 being used, the support unit 3 preferably comprises two support elements 20,21.

Figure 4:
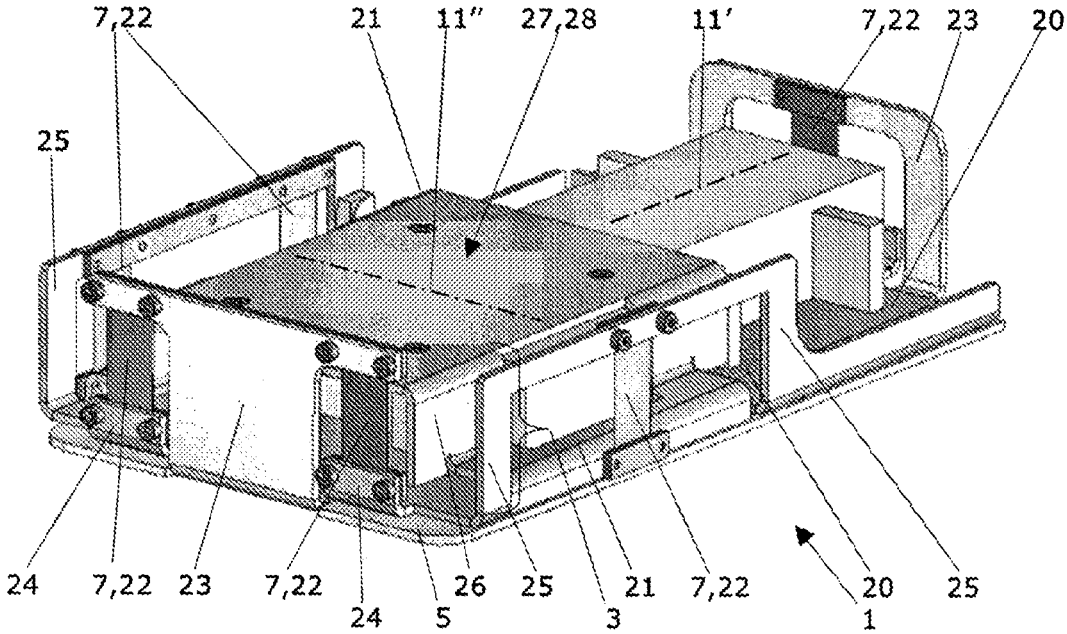
FIG. 4 shows a 3-D view of a first, especially preferred embodiment of the device according to the present invention for moving liquid containers having first and second support elements, which oscillate essentially perpendicularly to one another.

An especially preferred first embodiment of the device according to the present invention for moving liquid containers having first and second support elements 20,21 is shown in FIG. 4. These two support elements 20,21, which are suspended on leaf springs 22, oscillate essentially perpendicularly to one another. The support unit 3 moves freely in any arbitrary essentially horizontal direction by the addition of the oscillation movements of the two support elements 20,21. The base unit 5 actually comprises bent-up support parts 23, which each support at least one leaf spring 22 on each side of the base unit 4. Two or more leaf springs are used on one (cf. FIG. 4) or both sides to improve the horizontal stability. The additional leaf springs strengthen the spring action, but they also reduce the deflection achievable using the movement of the movement mass 8. Depending on the weight of the liquid containers to be moved and depending on the requirements for the acceleration of the movement mass 8, i.e., the requirements for the accelerations of the liquids in the liquid containers 2 present on the support unit 3, the number and/or spring strength of the leaf springs 22 may be tailored to the demands.

The leaf springs 22 or connection elements 7 fastened to the bent-up support parts 23 of the base unit 4 are clamped hanging here and support bent-up hanging parts 24 of the first support element 20. This first support element 20 comprises bent-up support parts 25, on which connection elements 7, also implemented as leaf springs 22, are again clamped hanging. These leaf springs 22 are also fastened clamped on the bent-down support element 21. Three leaf springs are also preferably provided here, which connect the first and second support elements 20,21 to one another.

The horizontal section 27 of the bent-up part 26 of the second support element 21 forms the effective support surface 28 of the support unit 3, which comprises the first and second support elements 20,21. Preferably, each of the support elements 20,21 is equipped with one movement mass 8 and one movement means 6 corresponding to the illustrations in FIGS. 1 through 3. The corresponding axis of symmetry 11" (and movement direction) is shown for the second support element 21 in FIG. 4. The axis of symmetry 11' (and movement direction) of the first support element 20 is perpendicular to the shown axis of symmetry 11" and is also indicated here. The movement masses or oscillators 8 are preferably mounted so they are movable linearly and almost without lateral play on friction-minimized friction bearings. If especially high requirements are placed on the friction bearings, linear guides may also be provided for the sliding mounting of the oscillators. The support surface 28 moves in a freely oscillating way in an essentially horizontal plane in all directions due to the superposition of the movements of the first and second support elements 20,21.

In general, two support elements 20,21 must be used to utilize essentially torsion-resistant leaf springs made of steel. For example, the support element 20 executes essentially horizontal reciprocating movements exclusively in the X direction, for example, and the support element 21 executes essentially horizontal reciprocating movements exclusively in the Y direction perpendicular thereto, for example. This configuration successfully prevents or minimizes undesired and uncontrollable increasing oscillation of the support surface 28, which supports a liquid container, of the support element 3 in a reciprocating movement about a Z axis.

Such increasing oscillation may particularly occur with support surfaces 28 suspended on cords or wires, which support a microplate having asymmetrical partially filled and partially empty wells. The embodiment of a device for moving liquid containers shown in FIG. 4 is completely insensitive to one-sided charging, in contrast. Even multiple microplates filled on one side stacked one on top of another are moved without problems and in a controlled way. Therefore, solid particles may be held in suspension, unstable emulsions may be emulsified, and mixing processes may be supported in practically arbitrary liquid containers.

In particular for incubators or fermenters used in biotechnology, bumpless shaking and/or mixing of cell cultures is made possible by the device according to the present invention. A vortex effect is even achievable in the liquid containers by the freely oscillating movement of the support surface 28, without the device discharging vibrations to the immediate surroundings. No radial forces arise on the device due to the freely oscillating suspension of all support elements 20,21 and by the movement means 6 and movement masses 8 inherent in these freely oscillating support elements, so that the device does not "travel". The preferred suspension of the support elements 20,21 on leaf springs does not cause any appearances of fatigue in the fastening or any uncontrolled loosening of screws by vibrations.

The actual movement of the support plate and thus also the liquid containers 2 is preferably ascertained for each movement direction in the X and Y axes using one Hall sensor each. This actual movement detection is used as a manipulated variable in the activation of the movement means 6 and movement masses 8. Activation of the movement means 6 using 2 frequencies and 2 deflections is especially preferred. The deflection of the support surface 28 may be tailored to the height and the diameter of the liquid containers 2, in particular the wells of a microplate. The smaller the deflection, the higher may be the selected frequency. The preferred deflection is approximately ⅓ to ½ the well diameter, which corresponds to a preferred deflection of approximately 3 mm for deep-well microplates. The frequency of an individually activated device according to the present invention is preferably 0.1 to over 4000 Hz.

In addition to linear reciprocating movements in any arbitrary direction in the essentially horizontal plane of the support plate, arbitrary, preferably cyclic movement patterns may be generated using the freely oscillating suspension of the two support elements 20,21 in FIG. 4 and by the movement means 6 and movement masses 8 inherent in these freely oscillating support elements. These may be polygonal stars, circles, rotating figure eights, and complex circular or elliptical movements, which correspond to the shape of a freeform figure, in particular a Lissajous figure. Movement sensors, preferably Hall sensors, again allow the detection of the effective movements of the support plate and the liquid containers 2 both in the X direction and also the Y direction of an essentially horizontal plane. The support surface 28 is preferably provided with a nonslip covering, such as a rubber mat or similar material and/or with retention springs 4 or other retention means.

It is preferable to pipette samples directly out of or into a liquid container 2 on the support surface 28. The analysis of the samples using optical analysis, detection of their pH or temperature, but also the robotic use of tweezers for removing sample parts are fundamentally desirable. Therefore, a device 1 according to the present invention preferably comprises a blocking apparatus, using which the support unit 3 and liquid containers 2 received thereon may be fixed in a predetermined position. Depending on the selected spring constant and/or number of the leaf springs, the support surface 28 is held so calmly that such a blocking apparatus may even be dispensed with.

Devices 1 which comprise a housing 31, which has an opening on its top side 32, through which a liquid container 2, in particular a microplate, may be laid on the support unit 3, are also especially preferred, the support unit 3 comprising a fixing mechanism 4 for fixing the liquid container 2. In order that this laying may be performed robotically and/or automatically, the fixing mechanism 4 for fixing the liquid container 2 on the support unit 3 is preferably implemented so it may be loosened by a microplate handling robot.

Figure 5:
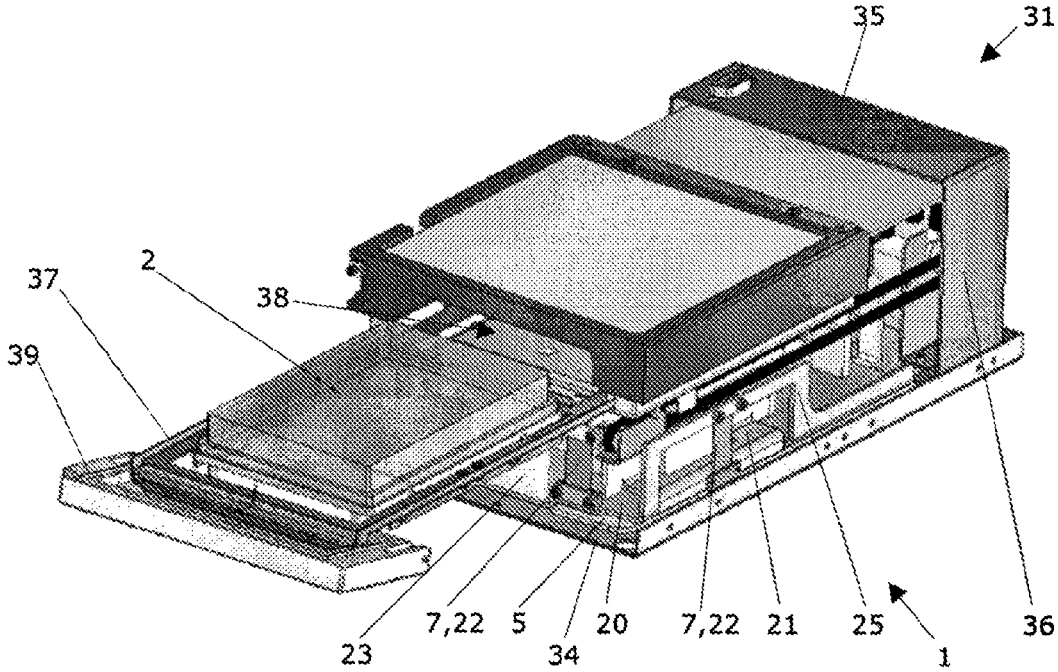
FIG. 5 shows a 3-D view of the device from FIG. 4, implemented as a stackable module, having a drawer unit for charging the horizontally freely oscillating support unit with a liquid container.

As is obvious from FIG. 5, such a housing 31 may additionally comprise a floor 34, a cover 35, and side walls 36 (floor and cover removed for better overview), as well as a slider 37 with side member 39 that is movably mounted in this housing 31. The housing 31 has an opening 38 on at least one side, through which the slider 37 is extendable to receive a liquid container 2, in particular a microplate, pull it into the housing 31, and lay it on the support unit 3. Such a support unit comprises a fixing device 4 (not shown) for retaining the liquid container 2. Such devices shown in FIG. 5 are preferably implemented as stackable modules, the floor 34 and the cover 35 being implemented as upper and lower stacking surfaces, in that they have relief structures implemented complementarily to one another, such as ribs and grooves and the like. In such a stack of devices 1, which are all located in an individual housing 31, all devices or groups thereof may be implemented individually as incubators, cooling chambers, or solely as shakers. Such stackable devices may be used as modules for equipping a workstation or a so-called "robotic sample processor" (RSP).

Furthermore, such devices 1 are preferably implemented as incubators, in that they comprise a temperature-controlled hot plate and thermal insulation situated on floor 34 and cover 35 as well as on all sides 36, which also closes opening 38. Alternative, preferred devices 1 are implemented as a cooling chamber, in that they comprise a temperature-controlled cooling plate and thermal insulation situated on floor 34 and cover 35 as well as on all sides 36, which also closes all openings 38. Peltier elements or so-called "heat pipes" are preferably used for the incubators or cooling chambers.

Devices for moving liquid containers deviating from the devices shown or described are part of the present invention, if one or more movement means 6 and one or more movement masses 8 are movably situated on their support unit, which are movable by these movement means and which set the support unit and the liquid containers thus received into corresponding counter movements by their movements.

The part of the support unit 3 identified as the support surface 28 may also be implemented as a coherent support frame or as a separate multiplex surface. Notwithstanding the embodiments shown or described up to this point, each rotating movement mass 8 may be magnetically connected to a rotating part of movement means 6. The movement means 6 are preferably then an electric motor, which is attached to the base unit 5 and on whose drive axis a permanent magnet is eccentrically fastened. The corresponding movement masses 8 are connected via a rotation axis to the support elements 20,21 or to the support unit 3 respectively. The rotation axis of the movement means 6 is essentially situated in the geometric axis of the corresponding movement mass 8. In addition, the movement masses 8 also have eccentrically fastened permanent magnets, which represent the opposite pole to the permanent magnets of the corresponding movement means 6. Because the two heteropolar permanent magnets of movement means 6 and corresponding movement mass 8 rotate around the shared geometric axis, in relation to which they are fastened on their individual rotational axes eccentrically offset by essentially the same amount, a rotating, magnetic coupling results between each movement means 6 and a movement mass 8 assigned thereto.

This configuration is particularly suitable for automated multiple configurations of fermenters or incubators in biotechnology, which have rotatable movement masses 8 each having at least one permanent magnet on one of their external walls or on their cover or floor. These fermenters are preferably equipped with stirring devices which are operationally linked to the movement masses 8. This operational link may be of a mechanical or magnetic nature. If these fermenters are conveyed from one stirring station to the next (preferably remote-controlled), the identically or differently situated movement means 6 of the next stirring station interact with one or more of the movement masses 8 of the fermenters, so that a movement tailored to the stirring station may be provided in the liquid located in the fermenters. The stirring stations may also differ in temperature and in other physical or chemical parameters. Alternatively, the entire fermenter may also be suspended freely oscillating and be brought into corresponding counter movements by the movement masses 8.

Although this embodiment was only discussed on the basis of fermenters, it is also suitable for other containers, in which liquids are to be stirred or otherwise moved especially carefully.

Identical reference numerals identify corresponding parts in figures, even if they are not cited in the description.

According to an especially preferred second embodiment (cf. FIGS. 6 and 7), the support unit 3 of the device according to the present invention comprises first and second support elements 20,21 having at least two rotatable movement masses 8 fastened to the second support element 21 and the movement means 6 associated therewith. The symmetrical positioning of four electric motors 40 under the second support element 21 is very especially preferred, the rotation axes 41 of these electric motors 40 being situated in the corners of a square. Selecting the rotational direction of the electric motors (and thus also the rotational direction of the wheels 43, which are preferably driven via toothed belts 42 and situated in the center of this square), which are diagonally opposite one another, in the same direction is especially preferred. In addition, these two motor pairs are activated synchronously. Using this configuration and mode of operation, any torques arising mutually cancel out, so that very calm running of the wheels 43 having the movement masses 8 attached inside the wheels (cf. FIGS. 7 and 8) or movement masses 8 attached outside the wheels (not shown) results. For the sake of clarity, only two of the total four wheels are shown in FIG. 7, the movement mass 8 only being visible in one wheel. In addition, the toothed belts 42 have a damping effect on any buildup of vibrations. The mutual very close positioning of the wheels 43 having their movement masses situated eccentrically thereon on a shared central axis 44 additionally helps to minimize the occurrence of undesired torques. The two support elements 20,21 of the support unit 3 are preferably situated and implemented identically as was already shown and explained in connection with FIGS. 4 and 5.

Notwithstanding this illustration, two movement masses 8, which move linearly back and forth either in the X direction or in the Y direction, e.g., in the direction of the axes of symmetry 11' or 11" (cf. FIG. 4), and the movement means 6 connected thereto may also be used.

Figure 6:
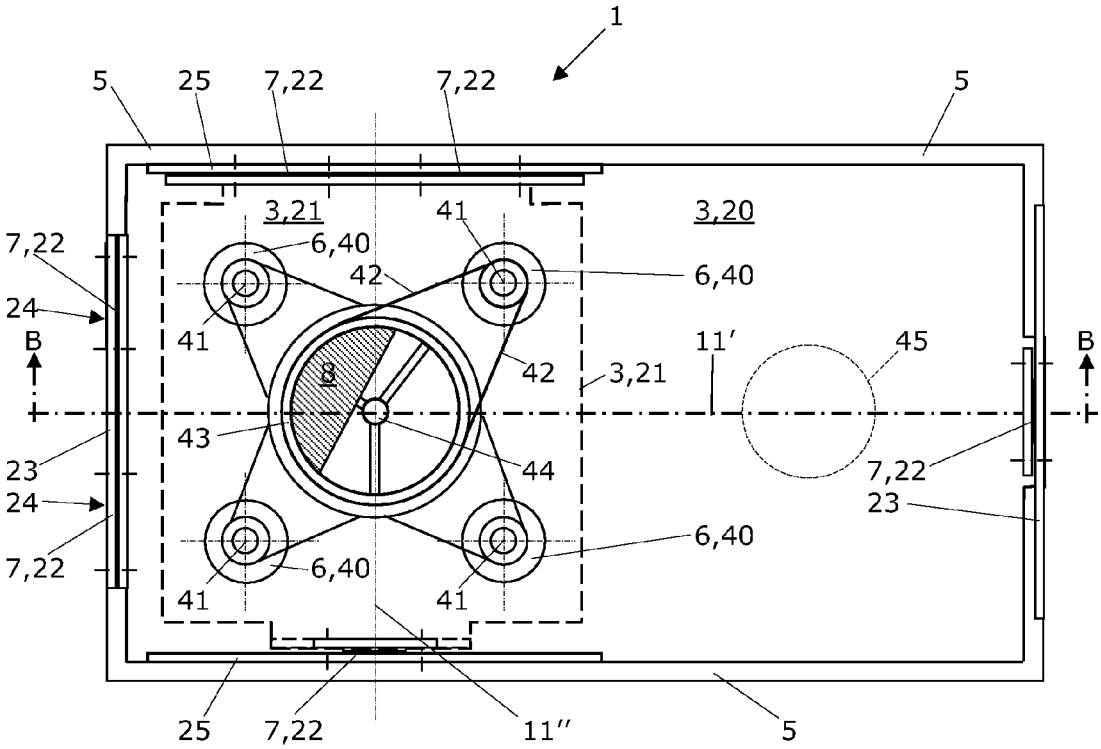
FIG. 6 shows a top view of a second, especially preferred embodiment of the device according to the present invention having first and second support elements.
Figure 7:
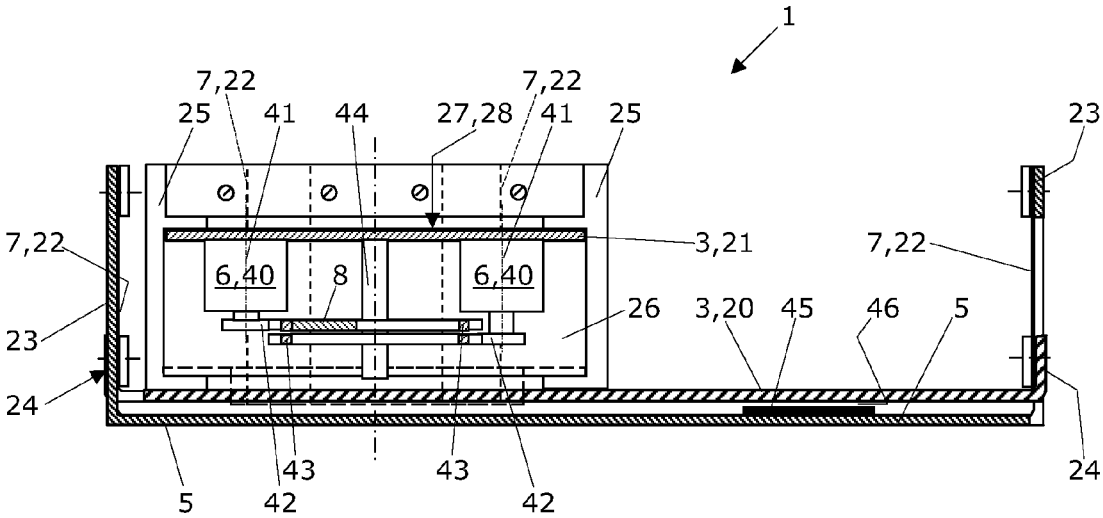
FIG. 7 shows a vertical partial section through the second embodiment of the device according to the present invention along section line B-B in FIG. 6.

All of the movements described here and above may be identified as the actual reciprocating movements of the support surface 28 about a mass center of gravity, this mass center of gravity being essentially determined in connection with the second preferred embodiment shown in FIGS. 6 and 7 by the mass of the support element 21 and all movement means 6 and movement masses 8 fastened thereto.

In connection with the suspension of the support surfaces 28 and/or the support elements 20,21 on flexible, limp elements, the problem of possible undesired rising oscillation has already been discussed. If this problem occurs when flexible, limp elements are used or in the second embodiment (cf. FIGS. 6 and 7), this rising oscillation is preferably successfully minimized or eliminated by the installation of an eddy current brake. As is generally known, eddy current brakes or also "hysteresis brakes" are based on the following principle: if a metal plate moves (here a support element 20 or 21 made of chrome steel or aluminum, for example) in an external magnetic field (here in the magnetic field of a permanent magnet 45 fixed on a base plate of the base unit 5; cf. FIGS. 6 and 7), eddy currents are induced in this metal plate. These eddy currents themselves in turn generate a magnetic field which opposes the external magnetic field. The electrical resistance of the metal plate forms an ohmic consumer for the eddy currents, by which the movement energy is converted into heat. The ability to magnetize the metal plate and/or the support elements 20,21 does not play any role, only the electrical conductivity thereof is decisive. The strength of the braking effect is a function of multiple parameters:

Conductivity of the brake plate or respectively the support element 20,21: a copper plate is braked more strongly than a steel or aluminum plate, for example, because the induced currents are higher as a result of the better electrical conductivity of copper.

Direction of the magnetic field: the greatest braking effect is achieved when the magnetic field penetrates the mobile plate perpendicularly.

Air gap: the larger the air gap 46, i.e., the distance between the permanent magnet 45 and the support element 20 (cf. FIG. 7), the smaller the maximum braking effect.

Area under the exciter pole: the smaller the area under the pole, the less the braking effect.

Velocity: the braking effect is strongly dependent on the relative velocity between field and plate, a larger relative velocity generating a greater braking effect.

One skilled in the art will optimize the parameters just listed in such a way that rising oscillation is successfully prevented. An eddy current brake of this type having a permanent magnet 45 has the advantage, inter alia, that it represents a completely passive system which does not require any type of controller. Such an individual eddy current brake is preferably provided for each of the support elements 20,21. A system having leaf spring suspensions may also be improved further by the use of such eddy current brakes.

The invention claimed is:

1. A device for moving liquid containers, comprising:

a support unit, comprising at least one support element and a support surface for receiving liquid containers;

a base unit, in relation to which said at least one support element of the support unit is mounted;

connecting elements that are implemented as flexible or spring connecting elements connecting said at least one support element of the support unit to the base unit, the connecting elements being the sole mechanical connection between the at least one support element and the base unit, the at least one support element thereby being implemented to substantially horizontal and free oscillation in relation to the base unit; and at least one movement means for moving the at least one support element of the support unit in relation to the base unit, wherein at least one movement mass is movably fastened to said at least one support element of the support unit, said at least one movement mass thereby being implemented to be moveable in relation to said at least one support element, wherein said at least one movement means is fastened to and is inherent in the same support element to which support element the at least one movement mass is moveably fastened, said at least one movement means being implemented to interact with said at least one movement mass, and wherein movements of said at least one movement mass set the support element supporting said at least one movement mass and the liquid containers received by the support unit, into corresponding counter movements, and wherein the base unit is free of radial forces due to the free oscillation of the at least one support element, without the device discharging vibrations to the immediate surroundings the device, said at least one support element and said support surface thus being implemented to carry out a counter movement to every movement of said at least one movement mass.

2. The device according to claim 1, wherein the support unit comprises a single support element having at least one linearly movable or rotatable movement mass fastened to the support element.

3. The device according to claim 1, wherein the support unit comprises first and second support elements having at least two linearly movable or rotatable movement masses fastened to this second support element.

4. The device according to claim 3, wherein the connection elements for mounting the first support element in relation to the base unit and the connection elements for mounting the second support element in relation to the first support element are hanging leaf springs.

5. The device according to claim 1, wherein the support unit comprises first and second support elements having at least one linear movable or rotatable movement mass fastened to each of these first and second support elements.

6. The device according to claim 5, wherein the connection elements for mounting the first support element in relation to the base unit and the connection elements for mounting the second support element in relation to the first support element are hanging leaf springs.

7. The device according to claim 1, wherein the movement means are electrically driven, and wherein the movement masses are linearly moveable and are implemented as a part of these movement means.

8. The device according to claim 7, wherein the linearly movable movement masses are moveable magnets.

9. The device according to claim 1, wherein the movement means are electrically driven, the movement masses being rotatable and magnetically or mechanically connected to a rotating part of one of these movement means.

10. The device according to claim 1, wherein the connection elements for mounting at least one of a first and second support element in relation to the base unit are implemented as hanging or upright.

11. The device according to claim 1, further comprising a blocking apparatus, using which the support unit and liquid containers received thereon may be fixed in a predetermined position.

12. The device according to claim 1, further comprising a housing that has an opening on its top side, through which a liquid container may be laid on the support unit, the support unit comprising a fixing mechanism for fixing the liquid container.

13. The device according to claim 12, wherein the liquid container is a microplate.

14. The device according to claim 13, wherein the fixing mechanism for fixing the liquid container on the support unit is implemented so it may be loosened by a microplate handling robot.

15. The device according to claim 1, further comprising a housing with a floor, a cover, side walls, and a slider that is movably mounted in this housing, the housing having an opening on at least one side, through which the slider is extendable to receive a liquid container that is then pulled into the housing and laid on the support unit.

16. The device according to claim 15, wherein the support unit comprises a fixing device for retaining the liquid container.

17. The device according to claim 15, wherein the liquid container is a microplate.

18. The device according to claim 15, which is implemented as a stackable module, the floor and the cover being implemented as bottom and top stacking surfaces, the top and bottom stacking surfaces having relief structures implemented as complementary to one another.

19. The device according to claim 15, which is implemented as a shaking incubator, wherein the device further comprises a temperature-controlled hot plate and thermal insulation that is situated on the floor, the cover, and on all sides, and that also closes all openings.

20. The device according to claim 15, which is implemented as a shaking cooling chamber, wherein the device further comprises a temperature-controlled cooling plate and thermal insulation that is situated on the floor, the cover, and on all sides, and that also closes all openings.

21. The device according to claim 1, further comprising at least one eddy current brake having a permanent magnet.

22. The device according to claim 1, wherein the support unit further comprises one or more movement sensors to detect the current movement of the support element supporting at least one liquid container.

23. The device according to claim 22, wherein the movement sensors are Hall sensors.

24. The device according to claim 1, further comprising stop springs for the support elements, which are mounted substantially horizontally freely oscillating, wherein the stop springs are permanent magnets oriented homopolar to one another.

25. A method for moving liquid containers using the device according to claim 1, the method comprising the steps of:

receiving liquid containers on the support surface of the support unit, the support unit being mounted to be substantially horizontally freely oscillating in relation to the base unit using the connection elements; and moving the support unit in relation to the base unit using the movement means, wherein the at least one support element of the support unit, on which the at least one movement mass is movably fastened, is moved using the at least one movement means that is fastened to the same support element and that interacts with the at least one movement mass independently of the base unit in such a way that movement of said at least one movement mass sets the support element supporting said at least one movement mass and the liquid containers received on the support unit into corresponding counter movements.

26. The method according to claim 25, wherein these counter movements correspond to one of a linear back-and-forth movement, a circular movement, an elliptical movement, and a movement which corresponds to the shape of a freeform.

27. The method according to claim 26, wherein the freeform is a Lissajous figure.

* * * * *